US008042198B1

(12) United States Patent
Cleveland

(10) Patent No.: US 8,042,198 B1
(45) Date of Patent: Oct. 25, 2011

(54) HEADGUARD WITH INDEPENDENTLY ADJUSTABLE UPPER AND LOWER BANDS

(75) Inventor: William K. Cleveland, El Cajon, CA (US)

(73) Assignee: Full90 Sports, Inc., San Diego, CA (US)

( * ) Notice: Subject to any disclaimer, the term of this patent is extended or adjusted under 35 U.S.C. 154(b) by 350 days.

(21) Appl. No.: 12/260,239

(22) Filed: Oct. 29, 2008

(51) Int. Cl.
*A42B 3/00* (2006.01)
*A42B 1/24* (2006.01)
*A42B 1/04* (2006.01)
*A63B 71/00* (2006.01)

(52) U.S. Cl. ..... 2/411; 2/414; 2/422; 2/425; 2/171

(58) Field of Classification Search ..... 2/410, 6.6, 2/416, 417, 418, 421, 422, 424, 425, 9, 171, 2/171.2, 171.4, 171.5, 171.7, 171.8, 181, 2/181.2, 181.4, 181.6, 181.8, 182.3, 183, 2/209.13, 209.14, 209.3, 209.4, 175.1, 175.2, 2/175.3, 175.4, 175.5, 175.6, 175.7, 175.8, 2/175.9, 195.1, 195.2, 195.3, 195.4, 195.5, 2/195.6, 195.7, 195.8, 918, DIG. 11; D2/865, D2/866, 877, 881, 884, 894
See application file for complete search history.

(56) References Cited

U.S. PATENT DOCUMENTS

| | | | | |
|---|---|---|---|---|
| 532,567 | A | 1/1895 | Larwood, Jr. | |
| 1,004,737 | A * | 10/1911 | Brewster | 2/463 |
| 1,023,285 | A * | 4/1912 | White | 2/9 |
| 1,209,093 | A | 12/1916 | Whitlow | |
| 1,237,048 | A | 8/1917 | Idoux | |
| 1,434,607 | A * | 11/1922 | Gilson | 132/274 |
| 1,463,810 | A | 8/1923 | Gilson | |
| 1,537,178 | A | 5/1925 | Maynard | |
| 1,638,756 | A | 8/1927 | Wallman | |
| 1,652,288 | A * | 12/1927 | Mullins | 2/418 |
| 2,391,335 | A | 12/1945 | O'Brien | |
| 2,607,036 | A | 8/1952 | McCoy | |
| 2,768,380 | A | 10/1956 | Golomb | |
| 2,969,547 | A | 1/1961 | Dye | |
| 3,082,428 | A * | 3/1963 | Zbikowski | 2/418 |
| 3,087,166 | A | 4/1963 | Howard | |
| 3,116,488 | A * | 1/1964 | Zbikowski | 2/418 |
| 3,159,160 | A | 12/1964 | Ullom | |

(Continued)

FOREIGN PATENT DOCUMENTS

CA 2316964 6/1999

(Continued)

OTHER PUBLICATIONS

Seven Photographs of "Gilbert Rugby" Protective Headgear.

(Continued)

*Primary Examiner* — Gary L Welch
*Assistant Examiner* — Jane Yoon
(74) *Attorney, Agent, or Firm* — Sherrill Law Offices, PLLC

(57) ABSTRACT

A protective headguard comprising a front pad, rear pad and left and right, upper and lower bands. The front pad protectively covers at least a portion of a human forehead. The left and right, upper and lower bands extend in opposite lateral directions from opposite sides of the front pad. The upper and lower bands form first and second tensioned circumferential lines of retention. The upper bands do not cooperatively interact with the lower pair of bands such that the upper and lower pairs of bands are independently adjustable so as to permit the first and second tensioned circumferential lines of retention to be separately and independently fitted to a human head.

4 Claims, 2 Drawing Sheets

U.S. PATENT DOCUMENTS

| | | | | | |
|---|---|---|---|---|---|
| 3,171,133 | A | | 3/1965 | Steffen | |
| 3,248,738 | A | | 5/1966 | Morgan | |
| 3,629,864 | A | | 12/1971 | Latina | |
| 3,725,956 | A | | 4/1973 | Reisen | |
| 3,784,984 | A | | 1/1974 | Aileo | |
| 3,843,970 | A | | 10/1974 | Marietta et al. | |
| 3,882,547 | A | | 5/1975 | Morgan | |
| 3,946,441 | A | | 3/1976 | Johnson | |
| 3,992,721 | A | | 11/1976 | Morton | |
| 4,023,209 | A | | 5/1977 | Frieder et al. | |
| 4,044,400 | A | | 8/1977 | Lewicki et al. | |
| 4,058,854 | A | | 11/1977 | Rhee | |
| 4,062,067 | A | | 12/1977 | Franzen | |
| 4,068,323 | A | | 1/1978 | Gwon | |
| 4,075,717 | A | | 2/1978 | Lemelson | |
| 4,204,543 | A | | 5/1980 | Henderson | |
| 4,222,122 | A | * | 9/1980 | Toms | 2/9 |
| 4,239,106 | A | | 12/1980 | Aileo | |
| 4,279,037 | A | | 7/1981 | Morgan | |
| 4,290,149 | A | | 9/1981 | Alieo | |
| 4,317,239 | A | | 3/1982 | Bryksa | |
| 4,345,336 | A | | 8/1982 | Plastino | |
| 4,354,284 | A | | 10/1982 | Gooding | |
| 4,398,306 | A | | 8/1983 | Gooding | |
| 4,404,690 | A | | 9/1983 | Farquharson | |
| 4,443,891 | A | | 4/1984 | Blomgren et al. | |
| 4,481,681 | A | | 11/1984 | Hankin | |
| 4,484,364 | A | | 11/1984 | Mitchel et al. | |
| 4,539,715 | A | | 9/1985 | Clement | |
| 4,558,470 | A | | 12/1985 | Mitchell et al. | |
| 4,581,773 | A | | 4/1986 | Cunnane | |
| 4,612,672 | A | | 9/1986 | Schrack | |
| 4,613,993 | A | | 9/1986 | Steele et al. | |
| 4,646,367 | A | | 3/1987 | El Hassen | |
| 4,698,852 | A | | 10/1987 | Romero | |
| 4,706,305 | A | | 11/1987 | Cho | |
| 4,710,985 | A | | 12/1987 | Dubner et al. | |
| 4,741,054 | A | | 5/1988 | Mattes | |
| 4,766,610 | A | | 8/1988 | Mattes | |
| 4,766,614 | A | | 8/1988 | Cantwell et al. | |
| 4,768,231 | A | | 9/1988 | Schrack | |
| 4,790,035 | A | | 12/1988 | Whyte | |
| 4,827,537 | A | | 5/1989 | Villa | |
| 4,843,642 | A | | 7/1989 | Brower | |
| 4,847,921 | A | | 7/1989 | Leutholt et al. | |
| 4,854,319 | A | | 8/1989 | Tobin | |
| 4,864,662 | A | | 9/1989 | Frank | |
| 4,910,804 | A | | 3/1990 | Lidgren | |
| 4,916,759 | A | | 4/1990 | Arai | |
| 4,947,488 | A | | 8/1990 | Ashinoff | |
| 4,982,451 | A | | 1/1991 | Graham | |
| 4,988,291 | A | * | 1/1991 | Grummons | 433/5 |
| 5,012,533 | A | | 5/1991 | Raffler | |
| 5,014,365 | A | * | 5/1991 | Schulz | 2/412 |
| 5,035,009 | A | | 7/1991 | Wingo et al. | |
| 5,042,093 | A | | 8/1991 | Legendre | |
| 5,044,016 | A | | 9/1991 | Coombs | |
| 5,075,903 | A | | 12/1991 | Richoux | |
| 5,081,717 | A | | 1/1992 | Shedd et al. | |
| 5,083,321 | A | | 1/1992 | Davidson | |
| 5,094,229 | A | * | 3/1992 | Pomatto et al. | 602/17 |
| 5,136,657 | A | | 8/1992 | Hattori | |
| 5,139,476 | A | * | 8/1992 | Peters | 602/26 |
| 5,173,970 | A | | 12/1992 | Shifrin | |
| 5,177,815 | A | | 1/1993 | Andujar | |
| 5,184,354 | A | | 2/1993 | Alfaro et al. | |
| 5,197,292 | A | | 3/1993 | McPherson | |
| D339,677 | S | | 9/1993 | Kang | |
| 5,271,103 | A | | 12/1993 | Darnell | |
| D343,927 | S | * | 2/1994 | Hamdan | D29/102 |
| 5,315,718 | A | | 5/1994 | Barson et al. | |
| 5,321,854 | A | | 6/1994 | Kronenberger | |
| 5,337,420 | A | | 8/1994 | Haysom et al. | |
| 5,341,516 | A | | 8/1994 | Keim | |
| 5,361,420 | A | | 11/1994 | Dobbs et al. | |
| 5,392,468 | A | | 2/1995 | Leddick, III | |
| 5,437,064 | A | | 8/1995 | Hamaguchi | |
| 5,450,631 | A | | 9/1995 | Egger | |
| 5,504,945 | A | | 4/1996 | Purnell | |
| 5,511,250 | A | | 4/1996 | Field et al. | |
| D370,309 | S | | 5/1996 | Stucky | |
| 5,515,546 | A | | 5/1996 | Shifrin | |
| 5,519,895 | A | | 5/1996 | Barnes, Jr. | |
| 5,535,454 | A | | 7/1996 | Ryan | |
| 5,539,934 | A | | 7/1996 | Ponder | |
| 5,544,367 | A | | 8/1996 | March, II | |
| 5,551,094 | A | | 9/1996 | Navone | |
| 5,557,807 | A | | 9/1996 | Hujar et al. | |
| 5,572,749 | A | * | 11/1996 | Ogden | 2/421 |
| 5,581,818 | A | | 12/1996 | Lorenzi et al. | |
| 5,615,419 | A | | 4/1997 | Williams | |
| 5,628,071 | A | | 5/1997 | Nezer | |
| 5,638,551 | A | | 6/1997 | Lallemand | |
| 5,640,721 | A | | 6/1997 | Jackson | |
| 5,659,900 | A | | 8/1997 | Arney et al. | |
| 5,661,854 | A | | 9/1997 | March, II | |
| 5,666,670 | A | | 9/1997 | Ryan et al. | |
| 5,680,656 | A | | 10/1997 | Gath | |
| 5,687,426 | A | | 11/1997 | Sperber | |
| 5,701,609 | A | | 12/1997 | Bridges | |
| 5,701,610 | A | | 12/1997 | Hsu | |
| 5,704,072 | A | | 1/1998 | Garneau | |
| 5,759,167 | A | * | 6/1998 | Shields et al. | 602/26 |
| 5,774,901 | A | | 7/1998 | Minami | |
| 5,790,988 | A | | 8/1998 | Guadagnino, Jr. et al. | |
| 5,794,270 | A | | 8/1998 | Howat | |
| 5,826,277 | A | | 10/1998 | McConville | |
| 5,862,528 | A | | 1/1999 | Saijo et al. | |
| 5,875,494 | A | | 3/1999 | Garnier et al. | |
| 5,882,205 | A | | 3/1999 | Peterson | |
| D410,768 | S | | 6/1999 | Hirsh | |
| 5,926,849 | A | | 7/1999 | Boyle | |
| 5,930,841 | A | | 8/1999 | Lampe et al. | |
| 5,933,872 | A | | 8/1999 | Lema | |
| 5,943,706 | A | | 8/1999 | Miyajima et al. | |
| 5,946,734 | A | | 9/1999 | Vogan | |
| 5,956,777 | A | | 9/1999 | Popovich | |
| 5,963,989 | A | | 10/1999 | Robertson | |
| 6,000,062 | A | | 12/1999 | Trakh | |
| 6,000,944 | A | | 12/1999 | Schiefer | |
| D423,725 | S | | 4/2000 | Krutouz | |
| 6,058,515 | A | | 5/2000 | Kitahara | |
| 6,065,159 | A | | 5/2000 | Hirsh | |
| 6,088,840 | A | | 7/2000 | Im | |
| 6,223,748 | B1 | * | 5/2001 | Chaves et al. | 128/857 |
| 6,266,827 | B1 | | 7/2001 | Lampe et al. | |
| 6,289,522 | B1 | * | 9/2001 | Jones et al. | 2/425 |
| 6,339,849 | B1 | | 1/2002 | Nelson et al. | |
| 6,349,416 | B1 | | 2/2002 | Lampe et al. | |
| 6,367,090 | B1 | | 4/2002 | Im | |
| 6,381,760 | B1 | | 5/2002 | Lampe et al. | |
| 6,385,780 | B1 | | 5/2002 | Racine | |
| 6,389,607 | B1 | | 5/2002 | Wood | |
| 6,397,399 | B1 | | 6/2002 | Lampe et al. | |
| 6,421,840 | B1 | | 7/2002 | Chen et al. | |
| 6,423,019 | B1 | * | 7/2002 | Papay et al. | 602/17 |
| 6,428,494 | B1 | * | 8/2002 | Schwenn et al. | 602/17 |
| 6,438,761 | B1 | | 8/2002 | McGarrita | |
| 6,467,099 | B2 | | 10/2002 | Dennis et al. | |
| 6,490,730 | B1 | | 12/2002 | Lyden | |
| 6,560,787 | B2 | | 5/2003 | Mendoza | |
| 6,571,799 | B1 | * | 6/2003 | Daly | 128/857 |
| 6,584,983 | B1 | * | 7/2003 | Nicot et al. | 132/53 |
| 6,592,536 | B1 | * | 7/2003 | Argenta | 602/17 |
| 6,625,820 | B1 | | 9/2003 | Lampe et al. | |
| 6,658,671 | B1 | | 12/2003 | Von Holst et al. | |
| 6,675,395 | B1 | | 1/2004 | Abraham | |
| 6,751,808 | B2 | | 6/2004 | Puchalski | |
| 6,773,449 | B2 | * | 8/2004 | Wexler | 606/204.15 |
| 6,925,657 | B2 | | 8/2005 | Takahashi et al. | |
| 6,978,487 | B2 | | 12/2005 | Urakawa | |
| 7,004,919 | B2 | * | 2/2006 | Gaylord et al. | 602/62 |
| 7,153,284 | B2 | * | 12/2006 | Argenta | 602/17 |
| D626,243 | S | * | 10/2010 | Sagnip et al. | D24/190 |
| 2001/0032351 | A1 | | 10/2001 | Nakayama et al. | |
| 2001/0047537 | A1 | | 12/2001 | Robertson | |
| 2002/0004494 | A1 | | 1/2002 | Bachienga | |

| | | | | |
|---|---|---|---|---|
| 2002/0017805 | A1 | 2/2002 | Carroll, III et al. | |
| 2002/0023291 | A1 | 2/2002 | Mendoza | |
| 2002/0069452 | A1 | 6/2002 | Knappl | |
| 2002/0083512 | A1* | 7/2002 | Tsujino | 2/423 |
| 2002/0152542 | A1 | 10/2002 | Dennis et al. | |
| 2002/0189004 | A1 | 12/2002 | Aaron | |
| 2004/0117896 | A1 | 6/2004 | Madey et al. | |
| 2004/0168246 | A1 | 9/2004 | Phillips | |
| 2004/0250340 | A1 | 12/2004 | Piper et al. | |
| 2005/0044611 | A1 | 3/2005 | Abraham | |
| 2005/0166302 | A1 | 8/2005 | Dennis | |
| 2005/0251898 | A1* | 11/2005 | Domingos | 2/412 |
| 2006/0059605 | A1 | 3/2006 | Ferrara | |
| 2006/0064798 | A1 | 3/2006 | Abraham | |
| 2006/0101559 | A1 | 5/2006 | Moore et al. | |
| 2006/0162054 | A1 | 7/2006 | Lardeau | |
| 2006/0260026 | A1 | 11/2006 | Doria et al. | |
| 2006/0264794 | A1* | 11/2006 | Fuchs et al. | 602/26 |
| 2007/0000032 | A1 | 1/2007 | Morgan | |
| 2007/0245451 | A1 | 10/2007 | Desjardins et al. | |
| 2008/0172779 | A1 | 7/2008 | Ferguson | |
| 2008/0184457 | A1* | 8/2008 | Pham | 2/209.13 |
| 2008/0201825 | A1 | 8/2008 | Chun | |
| 2009/0255030 | A1 | 10/2009 | Guy | |
| 2010/0162472 | A1* | 7/2010 | Abraham | 2/411 |

FOREIGN PATENT DOCUMENTS

| | | |
|---|---|---|
| DE | 10003125 | 8/2001 |
| EP | 393238 | 10/1990 |
| FR | 2390616 | 5/1997 |
| GB | 2202729 | 10/1988 |
| GB | 2333690 | 8/1999 |
| GB | 2348110 | 7/2002 |
| WO | 8804188 | 6/1988 |
| WO | 9614768 | 5/1996 |
| WO | 9929199 | 6/1999 |
| WO | 0145526 | 6/2001 |

OTHER PUBLICATIONS

Seven Photographs of "CCC" Protective Headgear.
"Can sports-Minded Kids Have Too Many Helmets?" Thomas B. Cole, JAMA, vol. 275, No. 8, May 18, 1996.
"Head and Neck Injuries in Soccer" Alf Thorvald Tysvaer, 1992.

* cited by examiner

HEADGUARD WITH INDEPENDENTLY ADJUSTABLE UPPER AND LOWER BANDS

BACKGROUND

The prior art contains many examples of protective headguard systems. The prior art describes a variety of fit and retention systems.

Headguard fit and retention systems are intended to keep the headgear on the head during use, maintain fit and comfort while in use, and allow the user to easily put on and take off the headgear when desired.

Fit and retention systems must deal with the basic characteristics of the human head: the generally spheroidal shape; the neck; and the various features such as the face, ears, frontal bone, occipital bone, or the parietal eminences.

Protective helmets use various means to improve retention and fit. For those with hard and stiff shells, compressible padding, padding inserts, and adjustable suspension are some of the means by which different head sizes can be accommodated. Football, hockey, bicycle helmets, and construction hard hats would fall into this category. For headgear with soft flexible shells, such as the headgear used in boxing, the martial arts, or soccer, the shape of the entire piece of headgear can be altered with, for example, adjustment straps to help conform it to the shape of the head.

In many instances, however, additional retention means such as chinstraps become necessary. Chinstraps typically attach near the edges of the helmet close to the ears and either pass under the chin or over the chin. A fastening system such as a buckle or snap allows the user to fasten and unfasten the chinstrap.

While chinstraps may help retain a helmet on the head, chinstraps can pose problems. First, chinstraps may heighten risk by increasing the rigidity of the head protection system. Forces applied to the head at angular vectors may cause the helmet and the head to rotate. Significant rotational forces can harm both the brain and the neck. An inflexible chinstrap therefore may contribute to injury by placing additional strain on the head as it rotates.

Second, chinstraps often require difficult and inconvenient adjustments for proper fit. In many instances such adjustments may be difficult and inconvenient. Third, chinstraps are often uncomfortable. Chinstraps that run over the chin usually require a cup to fit on the chin. A chin-cup may restrict the jaw and limit activities such as speech. Finally, even properly adjusted chinstraps may do little to prevent minor shifts in the helmet during normal use. These minor shifts can be very bothersome for activities, for example, that require unimpeded sight.

Various means have been attempted to improve fit and retention to overcome the shortcomings of systems that rely primarily on the chinstrap. Doing so often requires balancing fit, retention, and comfort. With almost any headgear, retention can be improved by simply making the headgear fit tighter. For headgear such as knit winter hats or winter headbands this does not typically pose a problem. A knit winter hat can fit relatively tight without causing discomfort. The lightness, elasticity, and conformability of such headgear are likely reasons for this.

For many kinds of protective headgear, however, creating a tighter fit merely results in discomfort. An American football helmet with a tight fit can be very uncomfortable. The bulk, inelasticity of the headgear structure, and the pressure points created where padding is compressed to fit variations on the head's surface could be causes for this.

Alternatives to simply tightening the fit have been developed. Many bicycle helmets, for example, have devices that cradle the occipital bone. These systems are not intended to eliminate the chinstrap but are intended to prevent minor shifts during normal use and to reserve the chinstrap for events such as accidents. These systems rely on a retention system that applies pressure to selected points on the head. In the case of the bicycle helmets with the occipital cradle, what amounts to a triangular retention system is created. In this system pressure is applied to a set of points below the occipital bone, points above the occipital bone, and points approximately in the middle of the forehead. However, these systems still rely on a chinstrap for retention purposes. Therefore there is still a pressure point under the chin.

U.S. Pat. No. 5,806,535 to Becker describes a head band with upper and lower bands continuously interconnecting along an entire circumference of a head.

International Patent No. PCT/KR03/001691 to Kim describes a head band with upper and lower bands episodically continuously interconnecting along an entire circumference of a head.

U.S. Pat. No. 6,397,399 to Lampe et al. teaches padding enclosed in a fabric covering. The fabric covering stretches to conform the padding to the head.

U.S. Pat. Nos. 6,266,827 and 6,349,416 to Lampe et al. reveal fit and retention systems with adjustment straps located in positions other than those where chinstraps would typically be located. Unlike a baseball cap, these devices may have two or more dependent circular lines of retention created by ribs which are fastened together in an overlapping position to conform to a human head.

SUMMARY OF THE INVENTION

The present claimed invention is directed to a protective headguard comprising a front pad, rear pad and left and right, upper and lower bands. The front pad is configured and arranged to protectively cover at least a portion of a human forehead when the headguard is worn on the head. The left and right upper bands extend in opposite lateral directions from opposite sides of the front pad. The upper bands cooperate to form a first tensioned circumferential line of retention encircling the head when the headguard is worn on the head. The left and right lower bands extend in opposite lateral directions from opposite side sides of the front pad. The lower bands cooperate to form a second tensioned circumferential line of retention encircling the head when the headguard is worn. The upper bands do not cooperatively interact with the lower pair of bands such that the upper and lower pairs of bands are independently adjustable so as to permit the first and second tensioned circumferential lines of retention to be separately and independently fitted to a human head.

DETAILED DESCRIPTION OF A PREFERRED EMBODIMENT

Nomenclature

10 Headguard
20 Front Pad

30 Bands
32 Left Upper Band
34 Right Upper Band
36 Left Lower Band
36*s* Left Scallop
38 Right Lower Band
38*s* Right Scallop
39 Hook and Loop Tape
39*a* Hook Portion of Hook and Loop Tape
39*b* Loop Portion of Hook and Loop Tape
40 Adjustment Straps
42 Left Upper Adjustment Strap
44 Right Upper Adjustment Strap
46 Left Lower Adjustment Strap
48 Right Lower Adjustment Strap
50 Rear Pad
52 Dimple
54 Channel
56 First Attachment Area
57 Second Attachment Area
100 Human Head
102 Forehead
104 Temple Area
106 Ear
108 Occipital Bone
T Longitudinal Center Line
L Lateral Line
P Transverse Line Construction The present claimed invention is intended to improve fit and retention of a headguard 10 around a human head 100. The shape of the human head 100, above the eye brows, is basically a cone. When any flat object, such as a headband or headguard 10, is wrapped around the head 100 it has a tendency to "slip or slide" upward. The slippage of the headguard 10 exposes areas on the head 100 that the headguard 10 is designed to protect and causes the user discomfort. The headguard 10 can be used for many purposes. For example, uses could include soccer or other activities where a lightweight, well-ventilated, snug fitting, and securely affixed protective headguard 10 is desirable. As a person perspires the headguard 10 will have a greater tendency to move out of its intended position.

Figure 1:
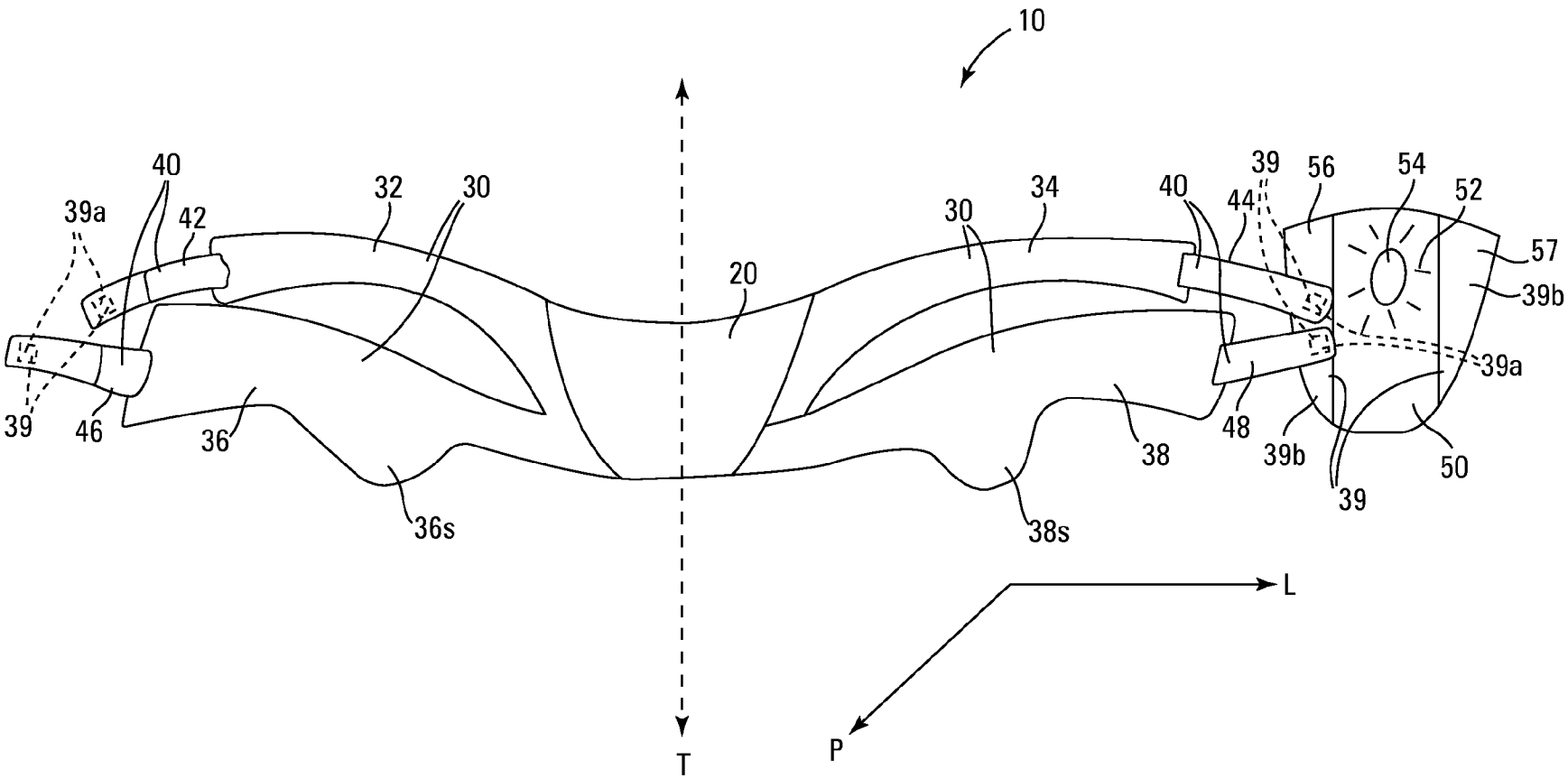
FIG. 1 is a front perspective view of an embodiment of the present invention when laid flat.
Figure 2:
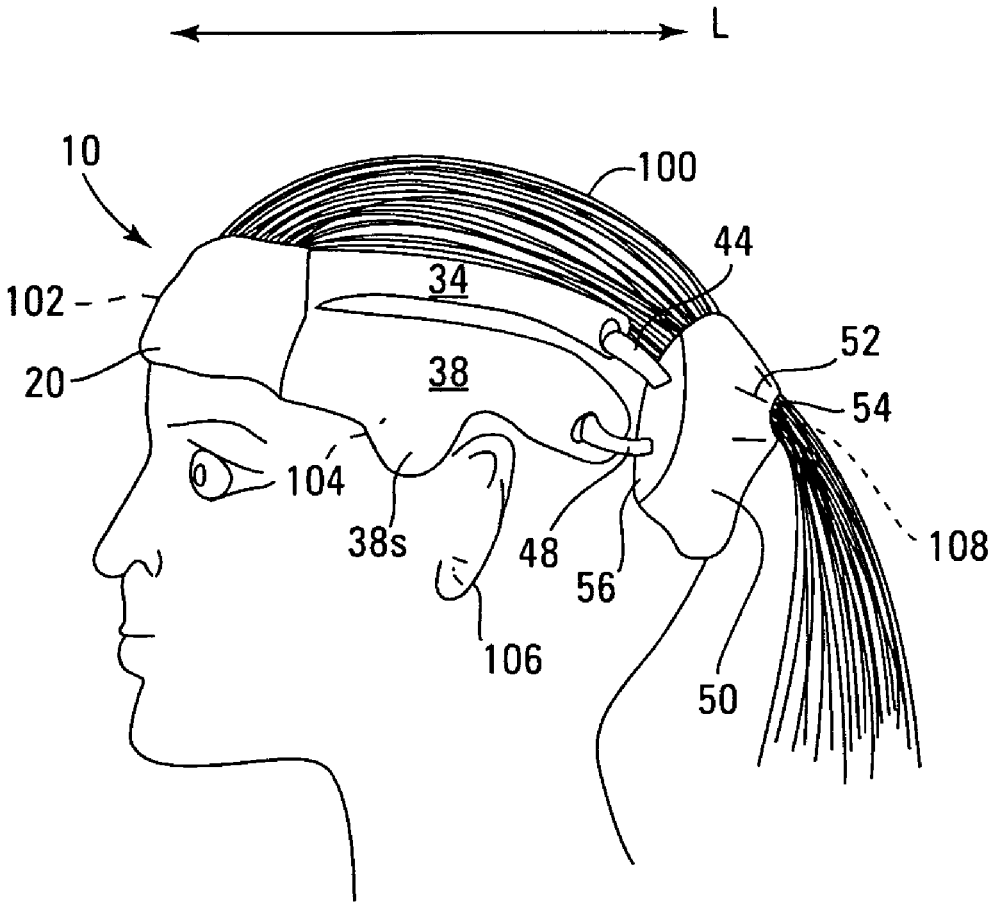
FIG. 2 is a side elevation view of the embodiment of the invention of FIG. 1 worn on a human head.

FIGS. 1-2 show the headguard 10 of the present claimed invention. The headguard 10 comprises a front pad 20, a rear pad 50, left and right, upper and lower independently adjustable bands 32, 34, 36, and 38 (collectively bands 30) and left and right scallops 36*s* and 38*s* on the left and right lower bands 36 and 38 respectively. As shown in FIG. 1, the front pad 20 can be oriented with a lateral line L and a longitudinal line T that is perpendicular to line L. The longitudinal line T bisects the front pad 20 into two equal halves. The front pad 20 can further be oriented along a transverse line P denoting the thickness of the front pad 20. (The rear pad 50 can also be oriented in this fashion although this is not shown.).

The length of the front pad 20 is the maximum dimension of the front pad 20 measured parallel to the lateral line L. The width of the front pad 20 is the maximum dimension measured parallel to the longitudinal centerline T in the longitudinal direction. The thickness of the headguard 10 is the maximum dimension measured parallel to the line P.

As depicted in FIG. 2, the bands 30 extend laterally from the front pad 20 and wrap around the head 100. When measuring from the longitudinally extending center line T which bisects the front pad 20, the left and right upper bands 32 and 34 are a shorter lateral length that the left and right lower bands 36 and 38. The left and right upper bands 32 and 34 will wrap around a human head 100 and connect to the rear pad 50 creating a first tensioned circumferential line of retention. The headguard 10 remains flush against the head 100 along the first line of retention. A second tensioned circumferential line of retention is created when the left and right lower bands 38 and 38 are secured flush around the head 100. Because the circumference of the first line of retention is smaller than the circumference of the second line of retention, the headguard 10 better fits the natural conical shape of a human head 100 minimizing the amount of slippage. Each of the four bands 30 are independently adjustable from each other. The bands 30 can each be individually adjusted to specific lengths determined by the user. This allows a user to customize the length of all the bands 30, independently adjusting the first and second circumferential lines of retention in order to secure the headband 10 comfortably upon a human head 100.

FIG. 2 shows a profile of a human head 100 with a headguard 10 positioned on it. In this embodiment the headguard 10 can encircle the head 100. The front pad 20 can cover an area from the forehead 102 to the temple area 104 on either side of the head 100 to a portion of the head 100 above the ears 106. The rear pad 50 can cover an area primarily on and around the occipital bone 108. Adjustment straps 42, 44, 46 and 48 (collectively straps 40), connect the left and right, upper and lower bands 30 to the rear pad 50 on either side of the head 100. The adjustment straps 40 can be made from an elastic material or stretchable foam to add additional tension to aid in retention of the headguard 10. Hook and loop tape 39 or a buckle (not shown) is provided proximate the distal ends (unnumbered) of the straps 40 and proximate on the left and right sides (unnumbered) of the rear pad 50 whereby the left attachment straps 44 and 48 can be attached to a first attachment area 56 on the left side of the rear pad 50, and the right attachment straps 42 and 46 can be attached to a second attachment area 57 on the right side of the rear pad 50. By adjusting the individual attachment strap 40 all four left and right, upper and lower bands 30 can be independently adjusted to optimally fit the human head 100.

Scallop 36*s* and 38*s* extend longitudinally downward from the left and right bands 36 and 38 respectively, to protectively cover at least a portion of the temple area 104 of a human head 100 without covering the ears 106. This allows the user to have protection to the critical temple area 104 while not sacrificing the ability to hear due to the headguard 10 covering the ear 106 muffling the surrounding sounds.

The rear pad 50 can have a cup shape or an eccentric dimple 52 to better accommodate a user's occipital lobe 108 to allow the rear pad 50 to be secured flush to the back of the head 100. The rear pad 50 can also have a channel 54 running through the rear pad 50 to accommodate a user's hair or pony tail to extend through the channel 54 providing for a more comfortable and securely fitting headguard 10.

The front pad 20, rear pad 50, bands 30 and scallops 36*s* and 38*s* can be made of many different materials. Closed cell foams of various kinds can be preferred for many applications. However, other kinds of foam including open-cell foams can be suitable for some applications. In addition, other forms of padding could be suitable. These could include gel materials. These can often be encased and sealed in stretchable films. Similarly, air or gases could be sealed in pockets (not shown) to provide padding. Finally, fibrous materials can also be used as padding.

The front pad 20, rear pad 50, bands 30, and left and right scallops 36*s* and 38*s* can also be encased in coverings. The coverings can be made of various kinds of materials such as fabric. For most applications, an elastic and highly breathable material would be most suitable. For example, a fabric such as Spandex® from Du Pont Company could be suitable for many applications. Many other fabrics such as CoolMax® from Invista could also be suitable. CoolMax® is a product that could aid in moisture management. Other materials such as mesh materials could be used alone or in combination with various fabrics.

I claim:

1. A protective headguard comprising;

(a) a front pad configured and arranged to protectively cover at least a portion of a human forehead when the headguard is worn on the head, (b) left and right upper bands extending in opposite lateral directions from opposite sides of the front pad, each of the upper bands forming an arc about the cranio-caudal axis of the head, and cooperating together to form a first tensioned circumferential line of retention encircling the head when the headguard is worn on the head, (c) left and right lower bands extending in opposite lateral directions from opposite sides of the front pad, each of the lower bands forming an arc about the cranio-caudal axis of the head, and cooperating together to form a second tensioned circumferential line of retention encircling the head when the headguard is worn on the head, (d) a rear pad configured and arranged to protectively cover at least a back portion of a human head and cooperatively interconnected to the upper and lower pairs of bands to participate in formation of the first and second tensioned circumferential lines of retention, (e) wherein the upper pair of bands do not cooperatively interact with the lower pair of bands such that the upper and lower pairs of bands are independently adjustable so as to permit the first and second tensioned circumferential lines of retention to be separately and independently fitted to a human, head and (f) wherein each band is independently and repositionably attachable to the rear pad at a plurality of cranio-caudial positions such that the angular relationship between an anterior-posterior extending plane dividing each band and the cranio-caudal axis of the head can be independently adjusted for each band.

2. The headguard of claim 1 further comprising adjustment straps independently connecting the left and right, upper and lower independent bands to the rear pad.

3. The headguard of claim 1 wherein the combined lateral length of the upper bands is less than the combined lateral length of the lower bands.

4. The headguard of claim 1 wherein the left and right lower independent bands are configured and arranged to protectively cover at least a portion of the left and right temples on the human head.

* * * * *